US005155872A

United States Patent [19]

Aymes

[11] Patent Number: 5,155,872

[45] Date of Patent: Oct. 20, 1992

[54] SWIMMING POOL WITH INTERLOCKING WALL PANELS AND LINER-RECEIVING TOP RAIL

[76] Inventor: Doniel G. Aymes, P.O. Box 1783, New Brunswick, N.J. 08902

[21] Appl. No.: 603,136

[22] Filed: Oct. 25, 1990

[51] Int. Cl.[5] ..... E04H 4/04

[52] U.S. Cl. ..... 4/506; 4/513; 52/247; 220/4.16

[58] Field of Search ..... 4/488, 506, 513; 405/277, 278, 279, 281; 52/245, 247; 220/4.11, 4.12, 4.16, 4.26

[56] References Cited

U.S. PATENT DOCUMENTS

| | | | |
|---|---|---|---|
| 2,020,795 | 11/1935 | Nolte | 405/277 |
| 2,861,277 | 11/1958 | Hermann | 220/4.16 X |
| 3,440,780 | 4/1969 | Adam et al. | 4/506 X |
| 3,492,826 | 2/1970 | Horstketter et al. | 405/281 |
| 3,736,599 | 6/1973 | Kessler et al. | 4/506 |
| 3,938,199 | 2/1976 | Laven | 4/506 X |
| 3,986,310 | 10/1976 | van den Broek | 4/506 X |
| 4,137,576 | 2/1979 | Greene | 4/506 X |
| 4,182,087 | 1/1980 | Schall et al. | 4/506 X |
| 4,635,304 | 1/1987 | Zikmanis et al. | 4/506 |
| 4,974,266 | 12/1990 | Vultaggio et al. | 4/506 |

FOREIGN PATENT DOCUMENTS

| | | | |
|---|---|---|---|
| 716950 | 12/1931 | France | 405/281 |
| 754438 | 11/1933 | France | 405/281 |

*Primary Examiner*—Henry J. Recla
*Assistant Examiner*—Robert M. Fetsuga
*Attorney, Agent, or Firm*—R. Neil Sudol; Henry D. Coleman

[57] ABSTRACT

An above-ground swimming pool comprises a side wall including a plurality of interlocking wall panels, a lower rail, an upper or top rail, a pool liner provided along an edge with a mounting bead, and a mounting component integral with the top rail member for receiving the bead on the liner. The lower rail member is provided with a first longitudinal channel for receiving a lower end or edge of the sidewall and the top rail member is provided with a second longitudinal channel for receiving an upper end or edge of the sidewall. The sidewall includes a plurality of elongate panel sections each provided along opposite longitudinal edges with cross-sectionally C-shaped locking elements for forming a locking relationship with adjacent panel sections. The sidewall further includes elongate buttress members provided along opposite edges extending perpendicularly with respect to the lower rail and the upper rail with cross-sectionally C-shaped locking elements for forming a locking relationship with adjacent panel sections. The buttress members include a longitudinally extending channel member and a pair of wing plates separate from the legs of the ohannel member and connected to the channel member along the base plate. The wing plates are provided along the opposite edges with respective longitudinally extending flanges in turn provided with the C-shaped locking elements. The panel sections and the buttress members are received in channels in the upper rail and the lower rail.

9 Claims, 3 Drawing Sheets

SWIMMING POOL WITH INTERLOCKING WALL PANELS AND LINER-RECEIVING TOP RAIL

BACKGROUND OF THE INVENTION

This invention relates to an above-ground swimming pool. More particularly, this invention relates to an above-ground swimming pool with interlocking sidewall panels.

Above ground pools all comprise a sidewall, a water-impermeable liner, and a frame or superstructure for supporting and reinforcing the sidewall. The frame assembly generally includes a lower rail and a top rail to which the pool sidewall is releasably attached. The liner is attached to an inner surface of the pool sidewall along an upper edge thereof.

OBJECTS OF THE INVENTION

An object of the present invention is to provide an above-ground swimming pool which is easier to manufacture and to install than conventional above-ground pools.

Another, more particular, object of the present invention is to provide such a swimming pool which has fewer parts than conventional above-ground pools.

A further particular object of the present invention is to provide such a pool which in which the provision of decorative color schemes is facilitated.

Yet another particular object of the present invention is to provide such a pool in which reinforcement of the sidewall is facilitated.

SUMMARY OF THE INVENTION

An above-ground swimming pool comprises, in accordance with the present invention, a side wall, a lower rail, an upper or top rail, a pool liner provided along an edge with a mounting bead, and a mounting component integral with the upper rail member for receiving the bead on the liner. The lower rail member is provided with a first longitudinal channel for receiving a lower end or edge of the sidewall.

Pursuant to another feature of the present invention, the upper rail member is provided with a second longitudinal channel for receiving an upper end or edge of the sidewall.

Pursuant to an additional feature of the present invention, the upper rail member is provided with an elongate plate defining in part the longitudinal channel which receives the lower ends of the side wall panel members. The liner mounting component is integral with the elongate plate.

Pursuant to a more specific feature of the present invention, the upper rail member includes a substantially planar main body portion having an inner longitudinal edge and an outer longitudinal edge substantially equidistant from one another. The elongate plate is integral with the main body portion along the inner longitudinal edge, while the liner mounting component is formed on the elongate plate along a free longitudinal edge thereof spaced from the main body portion of the upper rail member.

The liner mounting component takes the form of a J-shaped end portion along the free longitudinal edge of the elongate plate, the J-shaped end portion defining a bead-receiving groove.

Pursuant to another feature of the present invention, the pool sidewall includes a plurality of elongate panel members each provided along opposite longitudinal edges with elements for forming a locking relationship with adjacent panel members, the swimming pool further comprising a plurality of elongate buttress members each provided along opposite longitudinal edges with elements for forming a locking relationship with adjacent panel members.

In accordance with a specific realization of the present invention, at least one of the buttress members includes an elongate main plate which is concave on one side and convex on an opposite side. The opposite longitudinal edges of the main plate are provided with a pair of longitudinally extending flanges in turn provided with the elements for forming a locking relationship with adjacent side wall panels. The buttress member further comprises at least one elongate reinforcement plate integral with the main plate on the convex side thereof.

In accordance with another conceptualization of the present invention, at least one of the buttress members includes a channel member and pair of wing plates connected to the channel member along a base plate thereof. The wing plates are each oriented at an angle with respect to the base plate, while the longitudinal edges of the wing plates are provided with respective longitudinally extending flanges in turn provided with the elements for forming a locking relationship with with adjacent side wall panels.

An upper rail for an above-ground swimming pool comprises, in accordance with the present invention, a substantially planar main body portion, a channel on the main body portion for receiving an upper end of a wall panel, and a mounting component coupled with the main body portion or the pool side wall for receiving a bead of a swimming pool liner.

Pursuant to another feature of the present invention, the main body portion of the upper rail has an inner longitudinal edge and an outer longitudinal edge substantially equidistant from one another, the panel receiving channel and the liner mounting component being closer to the inner longitudinal edge than the outer longitudinal edge of the main body portion.

Pursuant to another feature of the present invention, the channel is defined by an elongate member which has a free longitudinal edge spaced from the main body portion of the upper rail. The liner mounting component is integral with the elongate member along the free longitudinal edge thereof.

More specifically, the elongate member defining in part the panel receiving channel is a first elongate plate member integral with the main body portion along the inner longitudinal edge. The channel is further defined by a second elongate plate member integral with the main body portion and extending equidistant from the first elongate plate member from a common major face of the main body portion. In that event, the liner mounting component takes the form of a J-shaped end portion along the free longitudinal edge of the first elongate plate member and the J-shaped end portion defines a bead-receiving groove.

Pursuant to a further feature of the present invention, liner mounting component further includes a shoulder along a free longitudinal edge of the J-shaped end portion, the shoulder projecting towards the first elongate plate member.

Pursuant to yet a further feature of the present invention, the upper rail member additionally comprises a plate member integral with the main body portion along the outer longitudinal edge.

A reinforcement member for an above-ground swimming pool comprises, in accordance with a first conceptualization of the present invention, an elongate main plate member which is concave on one side and convex on an opposite side. At least one elongate reinforcement plate is integrally connected to the main plate on the convex side thereof. Locking elements are provided along opposite longitudinal edges of the main plate member for forming an interlocking connection between the reinforcement member and side wall panel members adjacent to the reinforcement member along the opposite longitudinal edges. Each of the locking elements preferably takes the form of a cross-sectionally C-shaped component along each of the opposite longitudinal edges of the main plate member.

A reinforcement member for an above-ground swimming pool comprises, in accordance with another conceptualization of the present invention, an elongate channel member having a base plate and two leg plate. A pair of wing plates are connected to the channel member along the base plate, the wing plates each being oriented at an angle with respect to the base plate. In addition, the wing plates are provided with respective flanges each spaced from the base plate of the channel member, the flanges extending in planes substantially perpendicular to the respective wing plates. The flanges are provided with locking components for forming an interlocking connection between the reinforcement member and side wall panel members adjacent to the reinforcement member along the flanges.

A pool manufactured in accordance with the present invention has fewer parts than conventional above-ground pools and is accordingly easier to produce and install. A wide range of color schemes may be provided by having an inventory of wall panels of different colors and mixing the wall panels to form different looks for the swimming pools.

DETAILED DESCRIPTION OF THE INVENTION

Figure 1:
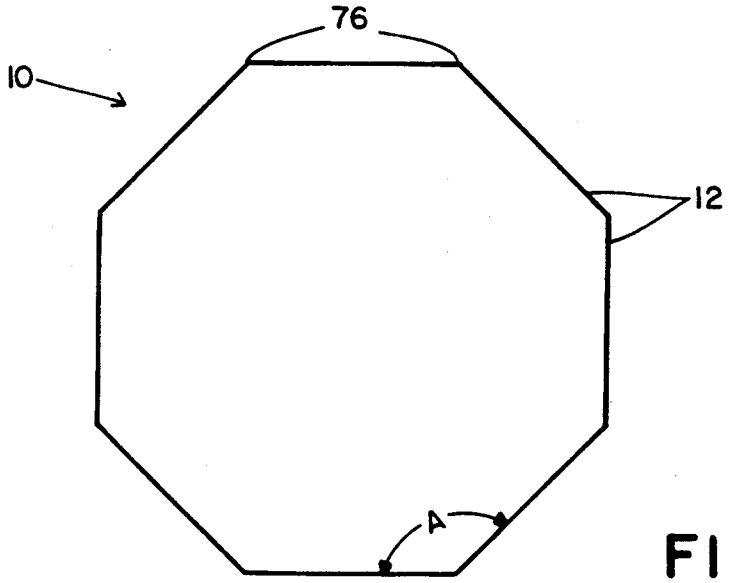
FIG. 1 is a schematic top plan view of a circular or regular polygonal above-ground swimming pool in accordance with the present invention.

FIG. 1 illustrates a swimming pool having a sidewall 10 with a plurality of panels 12 oriented at the same angle A with respect to one another.

Figure 2:
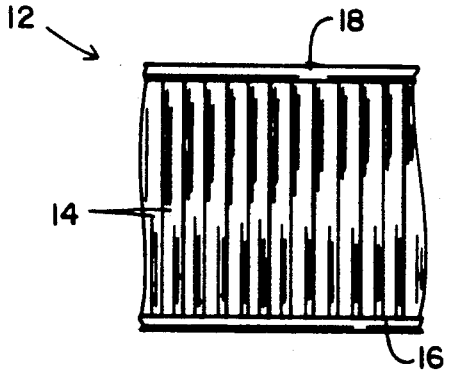
FIG. 2 is a schematic partial side elevational view of the swimming pool of FIG. 1.

As shown in FIG. 2, each sidewall panel 12 comprises a plurality of releaseably interlocked elongate panel sections 14 each mounted at a bottom end to a lower rail 16 and at a top end to an upper or top rail 18. Each panel section 14 is a modular unit having one of a predetermined plurality of colors. The different colors may be mixed and matched to provided a variety of easily assembled color schemes for the pool sidewall 10. For example, each panel section 14 may be white, brown, green or blue and may be arranged in alternating pairs of two different colors to form a pleasing aspect. Thus, in one such scheme two green panels alternate with two white panels around the circumference of the pool.

Figure 3:
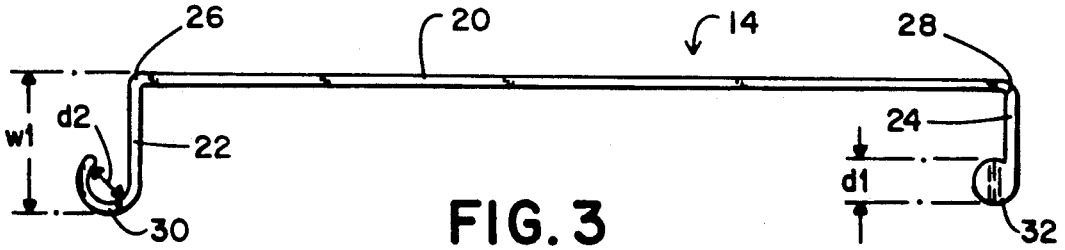
FIG. 3 is a top or end view, on an enlarged scale, of a panel section from the pool of FIGS. 1 and 2.

As illustrated in FIG. 3, a sidewall panel 14 comprises a planar elongate main body portion 20 having a pair of planar elongate flanges or legs 22 and 24 extending from opposite longitudinal edges or 26 and 28 of main body 20 perpendicularly thereto. Flange 22 is provided along a free edge, spaced from main body 20, with a generally C-shaped locking element 30. Flange 24 is formed along a free edge, spaced from main body 20, with a solid cylindrical locking element 32 having an outer diameter d1 smaller than an inner diameter d2 of C-shaped locking element 30. Locking elements 30 and 32 are elongate structures extending essentially the entire length of the respective flanges 12 and 24. Flange 22 has a width w1. Flange 24 has a width which is less than width w1 by a distance approximately equal to the wall thickness of locking element 30.

Figure 4:
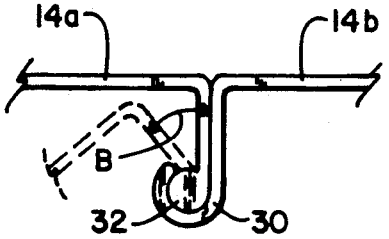
FIG. 4 is a partial top or end view of a pair of adjacent panel sections of FIG. 3, showing an interlocking interconnection between the two panel sections.

As shown in FIG. 4, two panel sections **14*a* and 14*b* identical to the panel section 14 illustrated in FIG. 3, are releasably attached to one another by inserting the solid cylindrical locking element 32 of one panel section 14*a* into the C-shaped locking element 30 of adjacent panel section 14*b* at the ends of the panel sections (i.e., perpendicular to the plane of the drawing sheet). The panel sections 14*a* and 14*b* may be disposed at an angle B with respect to one another during the assembly procedure but are pivoted from that relative angled orientation to an aligned configuration shown in solid lines in FIG. 4**.

Figure 5:
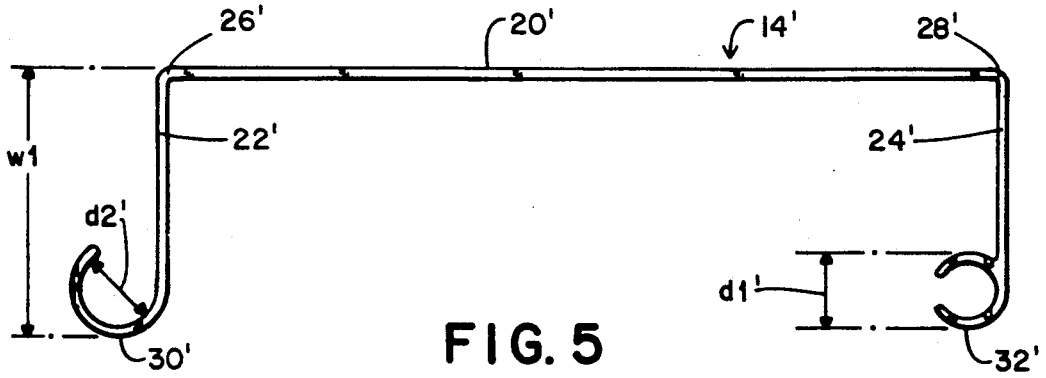
FIG. 5 is a top view, on a larger scale than in FIG. 3, of another panel section usable in an above-ground swimming pool in accordance with the present invention.

As shown in FIG. 5, another panel 14' utilizable in the pool of FIGS. 1 and 2 also comprises a planar elongate main body portion 20' having a pair of planar elongate flanges or legs 22' and 24' extending from opposite longitudinal edges 26' and 28' of main body 20' perpendicularly thereto. Flange 22' is provided along a free edge, spaced from main body 20', with a generally C-shaped locking element 30', while flange 24 is formed along a free edge with a slotted hollow cylindrical locking element 32' with an outer diameter d1' smaller than an inner diameter d2' of locking element 30'. Locking elements 30' and 32' are elongate structures extending essentially the entire length of the respective flanges 22' and 24'. Flanges 22' and 24' have a common width w1 which is the same width as flanges 22 and 24 of panel section 14 (FIG. 3).

The panel sections 14' of FIG. 5 are assembled with respect to one another in the same manner as the panel secions 14 of FIG. 3, as described above. Panel sections 14 and 14' provide a two-fold advantage in forming panels 12 of swimming pool sidewall 10: the channel-shaped panel sections 14 and 14' strengthen the pool sidewall because flanges 22, 24 and 22', 24' act as reinforcement ribs which prevent an outward bending of pool sidewall 10 under the water pressure in the pool upon installation. In addition, interlocking elements 30, 32 and 30', 32' hold adjacent panels 14 and 14' to one another and prevent a stretching of the pool sidewall under the action of the water pressure.

Panel sections 14 or 14' may be used exclusively with one another. Alternatively, panel sections 14 and 14' may be alternated or interdigitated around the pool circumference, e.g., for aesthetic reasons.

It is to be noted that panel sections 14' have the advantage over panels sections 14 of being lighter and less expensive, owing to the omission of material from interlocking element 32'.

Figure 6:
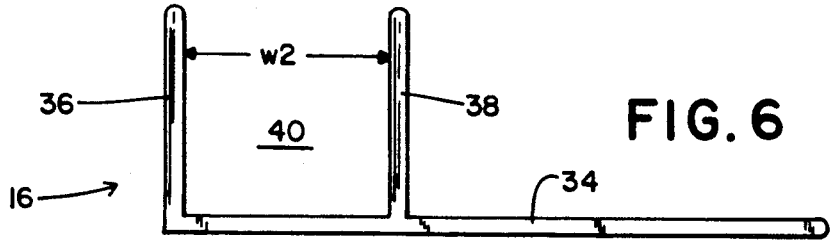
FIG. 6 is a side elevational view of a lower support rail in the swimming pool of FIGS. 1 and 2.

As illustrated in FIG. 6, lower rail 16 comprises an elongate base 34 provided on one side with a pair of parallel elongate upright plate members 36 and 38. Plate members 36 and 38 define panel-mounting means in the form of a channel 40 for receiving lower ends of panel sections 14 or 14'. Channel 40 has a width w2 which is at least slightly greater that width w1 of flanges 22, 24 and 22', 24'. The major portion of base 34 extends inwardly, under the pool, while channel 40 extends around the pool circumference.

In the case of an oval pool, base 34 is advantageously provided along the free edge of base 34 (right hand side in FIG. 6) with a downwardly depending flange (not shown) or a series of fingers (not shown) for providing a biting action with respect to a ground surface, thereby serving to anchor the lower rail to the ground in opposition to outwardly directed forces.

Figure 7:
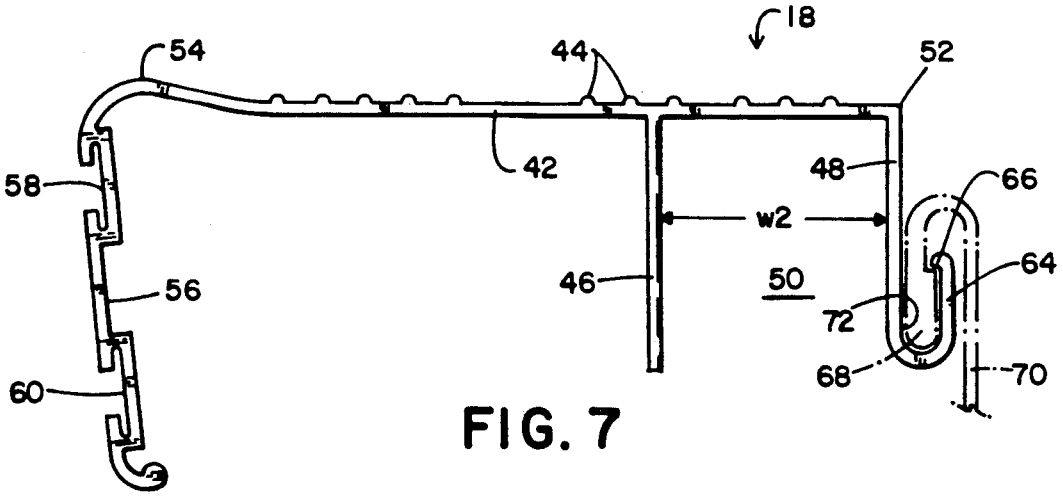
FIG. 7 is a side elevational view of an upper support rail in the swimming pool of FIGS. 1 and 2.

As depicted in FIG. 7, pool top rail 18 comprises an elongate, substantially planar, main body portion 42 provided along an upper surface with a plurality of elongate parallel beads 44 which provide an enhanced frictional surface. Along an underside, main body 42 is formed with a pair of parallel elongate plate members 46 and 48. Plate members 46 and 48 define panel-mounting means in the form of a channel 50 for receiving upper ends of panel sections 14 or 14'. Channel 50 has width w2 (the same width as channel 40 in FIG. 6) which is at least slightly greater that width w1 of flanges 22, 24 and 22', 24'. Plate member 48 is attached to main body 42 along an inner longitudinal edge 52 thereof, while along an outer longitudinal edge 54 region of main body 42 is attached an elongate outer plate or flange member 56. Flange member 56 is provided with a pair of elongate T-shaped slots 58 and 60 for receiving decorative strips (not illustrated).

Radially inward plate member 48 is provided along a free longitudinal edge with a J-shaped end portion 64. J-shaped portion 64 is in turn formed along a free edge with a shoulder 66 projecting towards plate member 48. As shown in phantom lines, a bead 68 formed along an edge of a swimming pool liner 70 is removably received into a groove 72 defined by J-shaped portion 64, whereby the upper edge of the liner is supported so that it maintains an essentially bowl- or cup-shaped configuration prior to and after filling with water.

Like lower rail 16 and panel sections 14 and 14', upper rail 18 is a unitary component. Elongate plate members 46 and 48, as well as J-shaped end portion 64 are all integral with main body 42.

Figure 8:
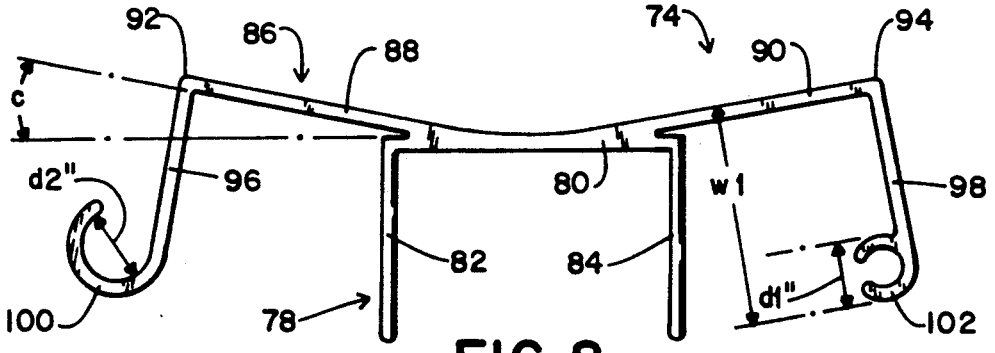
FIG. 8 is a top view of a buttress or reinforcement member used at the joints between adjacent sidewall panels in the swiming pool of FIGS. 1 and 2.

FIG. 8 illustrates a buttress member 74 which is inserted in channels 40 (FIG. 6) and 50 (FIG. 7) between lower rail 16 and upper rail 18 at vertical joints 76 (see FIG. 1) between adjacent panels 12 of pool sidewall 10. Buttress member 74 includes an elongate channel component 78 having a base 80 and two legs 82 and 84. Integral with base 80 is a V-shaped plate member 86 comprising a pair of wing plates 88 and 90 each extending from base 80 at an angle C having a size inversely proportional to pool diameter. Wing plates 88 and 90 are each provided, along a longitudinal edge 92 and 94 spaced from base 80, with a respective flange 96 and 98. Flanges 96 and 98 are oriented substantially perpendicularly to the respective wing plates 88 and 90. Along a free longitudinal edge (spaced from wing plate 88), flange 96 is formed with an elongate C-shaped locking element 100 having an inner diameter d2". Similarly, flange 98 is formed along a free longitudinal edge with a slotted cylindrical locking element 102 having an outer diameter d1". Outer diameter d1" and inner diameter d2" are preferably equal to outer diameters d1 and d1' and inner diameters d2 and d2', respectively.

It is to be noted that V-shaped plate member 86 is concave on a side opposite channel component 78 and convex on the other side. In addition, legs 82 and 84 of channel component 78 serves as elongate reinforcement plates integral with plate member 86 on the convex side thereof. Legs 82 and 84 thus serve the same anti-bending function as flanges 22, 24 and 22', 24' of sidewall panel sections 14 and 14'.

In installing a pool which incorporates buttress member 74, slotted cylindrical locking element 102 is longitudinally inserted into a C-shaped locking element 30 or 30' of a panel section 14 or 14'. In addition, slotted cylindrical locking element 32 or 32' of a panel section 14 or 14' is longitudinally inserted into C-shaped locked element 100 of buttress member 74.

Figure 9:
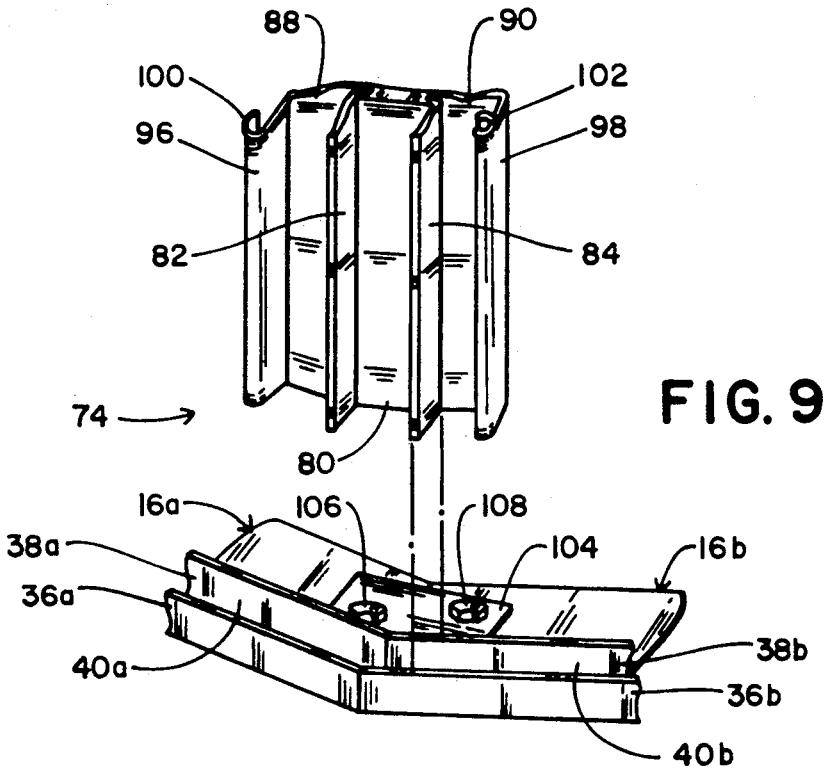
FIG. 9 is an exploded partial perspective view indicating insertion of a buttress member into a channel in a pair of interconnected lower rail members in the swimming pool of FIGS. 1 and 2.

As shown in FIG. 9, adjacent lower rail members 16*a* and 16*b* which are essentially identical to one another and to the rail member 16 shown in FIG. 6, are connected to one another by a coupling plate 104 and bolts 106 and 108. Elongate plate members 36*a* and 38*a* are aligned with plate members 36*b* and 38*b*, respectively, so that channels 40*a* and 40*b* communicate with one another and form a single channel with a bend at the joint between lower rail members 16*a* and 16*b*.

During installation, the lower end of buttress member 74 is inserted into channels 40*a* and 40*b* at the joint between lower rail members 16*a* and 16*b*. Like flanges 22, 24 and 22', 24', flanges 96 and 98 have width w1 (see FIG. 8) so that the flanges are insertable, preferably with a tight fit or a slight tolerance, into channels 40*a* and 40*b*.

Figure 10:
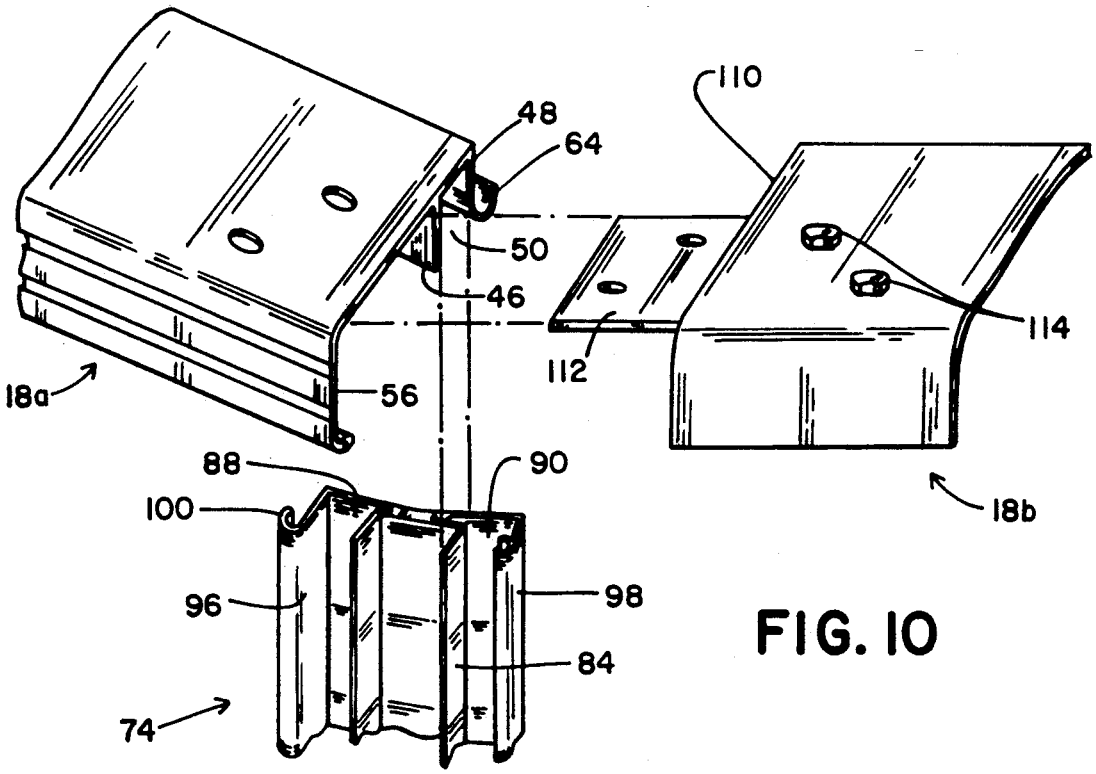
FIG. 10 is an exploded partial perspective view indicating insertion of a buttress member into a channel formed in a pair of interconnected upper rail members in the swimming pool of FIGS. 1 and 2.

As depicted in FIG. 10, two upper rails 18*a* and 18*b* which are essentially identical to one another and to the rail member 18 shown in FIG. 7 are connected at a joint 110 by means of a plate 112 and bolts 114. The elongate plate members 46 and 48 of the two upper rails members 18*a* and 18*b* are aligned with one another so that channels 50 of the two rails communicate with one another and form a single channel with a bend at the joint 110 between upper or top rail members 18*a* and 18*b*. During installation, the upper end of buttress member 74 is inserted into channels 50 at the joint 110 between lower rail members 18*a* and 18*b*.

It is to be noted that in the event that in an oval pool the buttress members 74 located along the flattened sides of the oval have wing plates 88 and 90 which are coplaner with base plate 80. Other buttress members between the rounded and the flattened sides of the oval sidewall may exhibit an angle C which is greater than zero but less than the angle of the buttress members along the rounded portions of the pool sidewall.

It is to be noted that the top rail member (FIG. 7) described and illustrated herein is different from conventional top rails which are separate from a channel member which receives the upper edge of the pool sidewall. Moreover, in conventional pools, the upper edge of the liner is mounted to the pool sidewall by a separate mounting element. The instant invention accordingly reduces the number of parts by incorporating both the sidewall and liner receiving components integrally into the top rail of the swimming pool. This advance results in considerable time and financial savings, both in manufacture and installation.

All of the elongate components of sidewall 10 (FIG. 1) including panel sections 14, 14', lower rail 16, top rail 18 and buttress member 74 are integral or unitary components made by extrusion. In the case of lower rails 16 and top rails 18, the extrusions are cut a predetermined angles corresponding to different pool sizes.

Although the invention has been described in terms of particular embodiments and applications, one of ordinary skill in the art, in light of this teaching, can generate additional embodiments and modifications without departing from the spirit of or exceeding the scope of the claimed invention. For example, the J-shaped liner bead receptor 64 may alternatively take the form of an inverted F, with a pair of inwardly directed parallel plates one or both of which are provided with shoulders to enable locking of a liner bead via a snap-lock fit.

What is claimed is:

1. An above-ground swimming pool comprising:

a side wall having a lower edge and an upper edge;

a lower rail member provided with a first longitudinal channel for receiving said lower edge of said sidewall;

a top rail member integrally provided with a second longitudinal channel for receiving said upper edge of said sidewall;

a swimming pool liner provided along an edge with a mounting bead; and mounting means on said top rail member for receiving said mounting bead;

said sidewall including a plurality of elongate panel sections each provided along opposite longitudinal edges with means for forming a locking relationship with adjacent panel sections, said sidewall further including a plurality of elongate buttress members each provided along opposite longitudinal edges with means for forming a locking relationship with adjacent ones of said panel sections, at least one of said buttress members being defined by a longitudinally extending channel member with a base plate and a pair of leg plates, said one of said buttress members further being defined by a pair of wing plates separate from said leg plates and connected to said channel member along said base plate, said wing plates each being oriented at an angle with respect to said base plate, said wing plates having free longitudinal provided with respective longitudinally extending flanges in turn provided with said means for forming a locking relationship.

2. The swimming pool defined in claim 1 wherein said top rail member is provided with an elongate plate defining said second longitudinal channel, said mounting means being integral with said elongate plate.

3. The swimming pool defined in claim 1 wherein said top rail member is provided with an elongate plate defining in part said second longitudinal channel, said mounting means being integral with said elongate plate.

4. The swimming pool defined in claim 3 wherein said top rail member includes a substantially planar main body portion having an inner longitudinal edge and an outer longitudinal edge substantially equidistant from one another, said elongate plate being integral with said main body portion along said inner longitudinal edge, said mounting means being formed on said elongate plate along a free longitudinal edge thereof spaced from said main body portion of said top rail member.

5. The swimming pool defined in claim 4 wherein said mounting means takes the form of a J-shaped end portion along said free longitudinal edge, said J-shaped end portion defining a bead-receiving groove.

6. An above-ground swimming pool comprising:

a side wall having a lower edge and an upper edge;

a lower rail member provided with first mounting means for receiving said lower edge of said sidewall; and a top rail member provided with second mounting means for receiving said upper edge of said sidewall;

said sidewall including a plurality of elongate panel sections each provided along opposite longitudinal edges with means for forming a locking relationship with adjacent panel sections, said sidewall further including a plurality of elongate buttress members each provided along opposite longitudinal edges with means for forming a locking relationship with adjacent ones of said panel sections, at least one of said buttress members being defined by a longitudinally extending channel member and pair of wing plates connected symmetrically to said channel member along a base plate thereof, said wing plates being separate from leg plates of said channel member and each being oriented at an acute angle with respect to said base plate said wing plates having free longitudinal edges provided with said means for forming a locking relationship.

7. The swimming pool defined in claim 6 wherein said said wing plates are provided along said free edges with respective longitudinally extending flanges in turn provided with said means for forming a locking relationship.

8. The swimming pool defined in claim 7 wherein said means for forming a locking relationship includes a first locking element provided along a free edge and and an outwardly facing surface of one of said flanges, said first locking element projecting in a direction substantially opposite said channel member, said means for forming a locking relationship further including a second locking element provided along a free edge and and an inwardly facing surface of another of said flanges, said second locking element projecting in a direction substantially towards said one of said flanges.

9. An above-ground swimming pool comprising:

a side wall having a lower edge and an upper edge;

a lower rail member provided with first mounting means for receiving said lower edge of said sidewall; and a top rail member provided with second mounting means for receiving said upper edge of said sidewall;

said sidewall including a plurality of elongate panel sections each provided along opposite longitudinal edges with means for forming a locking relationship with adjacent panel sections, said sidewall further including a plurality of elongate buttress members each provided along opposite longitudinal edges with means for forming a locking relationship with adjacent ones of said panel sections, at least one of said buttress members being defined by an elongate longitudinally extending main plate which is concave on one side and convex on an opposite side, said one of said buttress members further comprising at least one elongate reinforcement plate integral with and symmetrically disposed with respect to said main plate on the convex side thereof, said main plate having a pair of free longitudinal edges provided with respective longitudinally extending flanges in turn provided with said means for forming a locking relationship, said means for forming a locking relationship including a pair locking elements facing in substantially the same direction.

* * * * *